United States Patent [19]

Bunnell

[11] 3,935,637

[45] Feb. 3, 1976

[54] REMOVABLE WIRING DEVICE ASSEMBLY

[75] Inventor: Edward Dennman Bunnell, Palm Harbor, Fla.

[73] Assignee: AMP Incorporated, Harrisburg, Pa.

[22] Filed: Nov. 26, 1974

[21] Appl. No.: 527,451

[52] U.S. Cl. ..... 29/628; 29/203 H; 174/48; 174/58; 248/27 R; 339/97 P; 339/99 R

[51] Int. Cl.[2] ..... H01R 43/00

[58] Field of Search..... 339/97 P, 98, 99 R, 99 L; 174/48, 49, 53, 58; 200/168 R, 168 D; 248/27; 29/628, 630 R, 630 A, 203 H; 85/32 W, 32 WE, 32.1

[56] References Cited

UNITED STATES PATENTS

| | | | |
|---|---|---|---|
| 1,574,578 | 2/1926 | Holmes | 85/32 W |
| 1,981,363 | 11/1934 | Kimbell | 85/32 W |
| 2,051,953 | 8/1936 | Leathers | 85/32 W |
| 3,139,314 | 6/1964 | Miller | 339/198 S |
| 3,392,943 | 7/1968 | Baxter | 174/58 |
| 3,662,085 | 5/1972 | Robinson et al. | 174/58 |
| 3,723,948 | 3/1973 | Wyatt et al. | 339/99 R |
| 3,725,840 | 4/1973 | Hesse | 339/14 R |
| 3,860,739 | 1/1975 | Kloth et al. | 339/99 R |

*Primary Examiner*—C. W. Lanham
*Assistant Examiner*—James R. Duzan
*Attorney, Agent, or Firm*—Gerald K. Kita

[57] ABSTRACT

A technique is disclosed for using a commonly available, inexpensive and rugged tool for assembling together a cover and a base portion of a wiring device of the type providing a switch, junction box or outlet receptacles, and of the type wherein wires are connected electrically in the wiring device during assembly of the cover and base portion together.

7 Claims, 5 Drawing Figures

REMOVABLE WIRING DEVICE ASSEMBLY

BACKGROUND OF THE PRIOR ART

There has been a long existing need in the prior art to provide a technique for assembling a two-piece wiring device of the type providing either a switch, junction box or dual outlet receptacle, and of the type wherein multiple conductors are electrically connected to insulation penetrating electrical contacts contained in the wiring device during assembly of the two-piece wiring device. Particularly when the two-piece wiring device is assembled and simultaneously connected electrically to an elongated conductor by forcibly urging a cover portion and a base portion together a sturdy force-applying tool is required. Desirably the tool should be inexpensive, rugged, easy to use and of a common or standard design for availability. The wiring device itself should be adapted with assembly features that readily accommodate standard assembly tools.

BRIEF DESCRIPTION OF THE INVENTION

A two-piece wiring device includes a base portion having insulation penetrating electrical contacts and a cover portion which is forcibly urged toward the base portion to force individual conductors into electrical connection within the contacts and to cooperatively lock together the base portion and cover to thereby contain the electrical connections internally of the wiring device. The base is adapted with a jack screw adjacent a central contact which is electrically grounded in a circuit provided by the conductors. Access to the jack screw is provided by an aperture in the cover. A threaded fastener is received in the cover aperture and threadably driven along the jack screw to assemble the cover to the base and to simultaneously force the cover against the conductors electrically connecting the conductors within the corresponding terminals. The fastener is adapted to be threadably driven by a standard tool. The fastener can be removed once the cover is locked to the base, or the fastener can remain as an installed part of the cover. Alternatively the fastener can be incorporated as part of an assembly tool enabling removal of the fastener together with the tool subsequent to assembly. The fastener is electrically grounded to the jack screw and is forcibly urged against the ground conductor forcing it into electrical connection with a corresponding contact adjacent the jack screw. Thus the fastener and the assembly tool is safely grounded electrically such that removal of the fastener subsequent to assembly is not predicated upon the presence of an electrical hazard when the conductors are connected to an activated electrical circuit.

OBJECTS

It is accordingly an object of the present invention to provide a technique for utilizing a commonly available, rugged and inexpensive tool for assembling together a cover and a base portion of a wiring device of the type providing either a switch, junction box or dual outlet receptacles, and of the type wherein wires are connected electrically in the wiring device simultaneous with assembly of the cover and base together.

It is another object of the present invention to provide a wiring device having portions which are assembled in locked relationship while simultaneously forcing a plurality of conductors into electrical connection within insulation penetrating type contacts contained in the wiring device, utilizing a fastener which is urged to press on the electrically grounded conductor forcibly inserting it into electrical connection within the corresponding electrically ground contact, whereby the fastener becomes electrically grounded to the ground contact within the wiring device and is optionally removable subsequent to assembly of the base portion and cover portion.

Another object of the present invention is to provide a wiring device of the type wherein a cover is used to press the individual conductors of an electrical cable into electrical engagement within insulation penetrating contacts within the wiring device, and wherein the electrically ground conductor is engaged by a fastener device which may be a conductive portion of the cover and which becomes grounded electrically to the ground conductor and which either may be removed subsequent to assembly of the wiring device electrically to the cable or remain in place as an installed part of the cover of the wiring device.

It is a further object of the present invention to provide a technique for assembling together a two-piece wiring device while simultaneously connecting the wiring device to the individual conductors of an electrical cable using a tool which is easy to use, rugged, inexpensive and readily available while at the same time using a tool to engage and connect a ground conductor to an insulation penetrating type electrical contact of the wiring device thus enabling the tool to be removed or remain in place as an installed part of the wiring device while being grounded electrically to the ground conductor.

Other objects and many attendant advantages of the present invention will become apparent upon perusal of the following detailed description taken in conjunction with the accompanying drawings.

Figure 1:
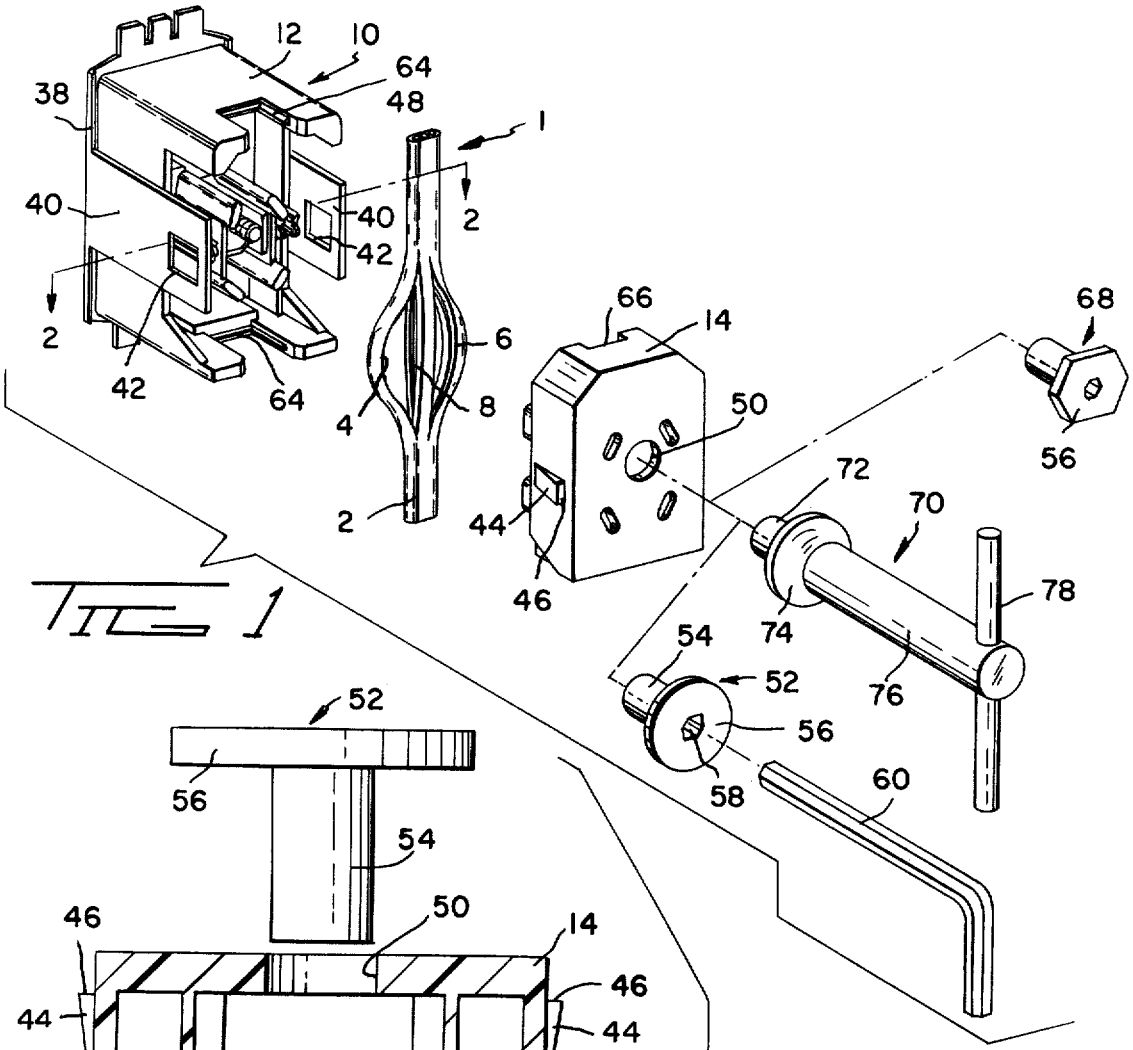
FIG. 1 is an exploded perspective of the component parts of a wiring device according to the present invention illustrating modifications of the structure utilized for connecting together the component parts.

With more particular reference to the drawings there is shown generally at 1 in FIG. 1 a fragmentary portion of an elongated electrical cable having an external sheath 2 and a plurality of individual conductors 4, 6, and 8 which include portions that are laterally spread apart from one another and exposed by slitting a portion of the sheath 2. Normally the conductors 4 and 6 contain individual insulation thereover while the central conductor 8 is generally uninsulated.

Figure 2:
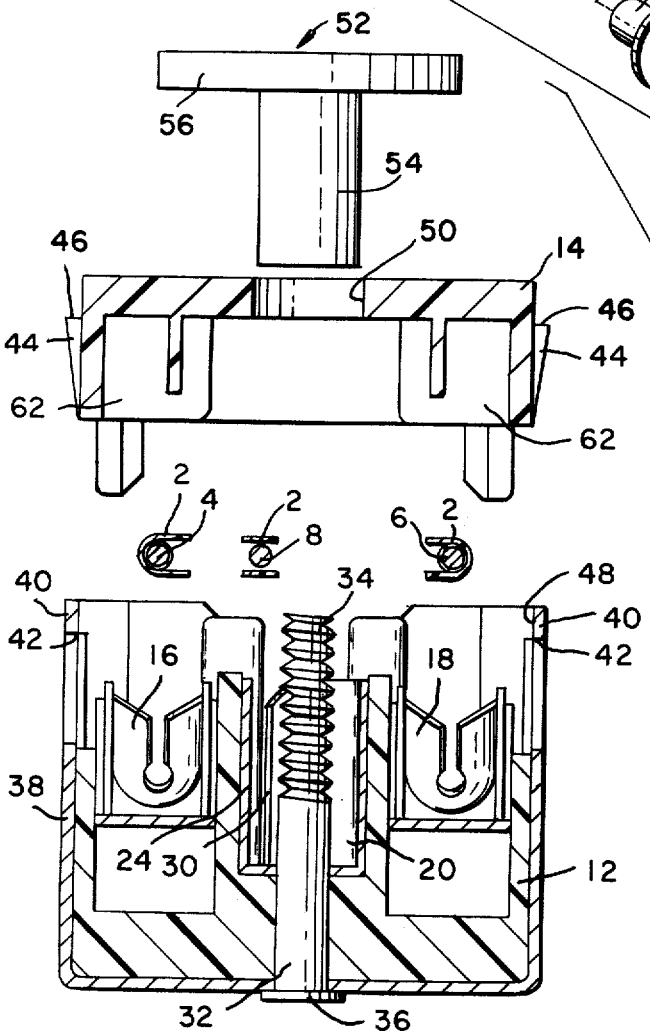
FIG. 2 is an enlarged fragmentary section taken along the lines 2—2 of FIG. 1 illustrating the details of assembly of the component parts.
Figure 3:
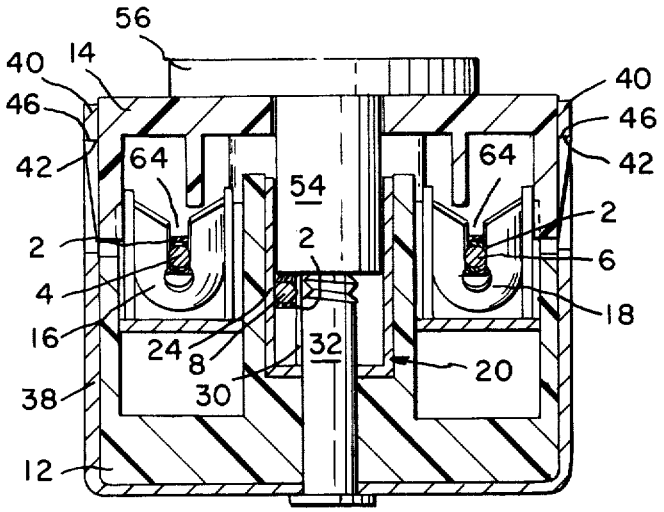
FIG. 3 is an enlarged fragmentary section similar to FIG. 2 illustrating the component parts fully assembled.
Figure 4:
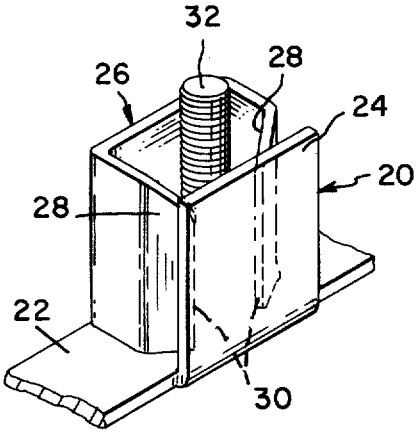
FIG. 4 is an enlarged fragmentary perspective of an electrically ground terminal of the wiring device according to the present invention.
Figure 5:
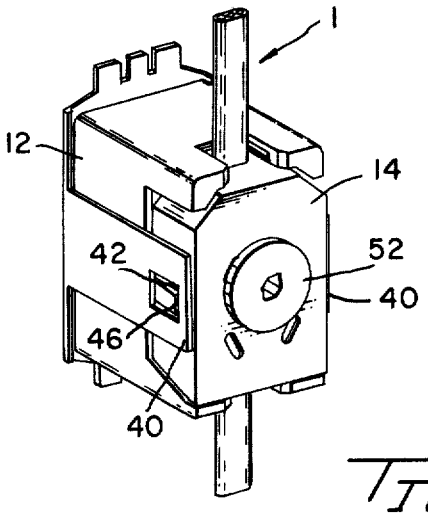
FIG. 5 is an enlarged fragmentary perspective of an assembled wiring device incorporating a selected interchangeable part as illustrated in FIG. 1.

There is illustrated generally at 10 a wiring device of the type providing dual receptacle outlets and having a dielectric base portion 12 and a cooperating dielectric cover 14. The wiring device 10 includes, as shown in FIGS. 1, 2, and 3, a plurality of electrical termianls 16, 18, and 20, contained within the base portion 12 and in laterally spaced relationship. The terminals 16 and 18 are of the insulation slicing or penetrating type and are more particularly disclosed in U.S. Pat. No. 3,854,114. The terminal 20 is more particularly illustrated in FIG. 4 as having a base portion 22 with an upstanding flange portion or back plate 24 and a generally channel-shaped portion 26. The channel-shaped portion 26 includes a pair of diagonally projecting flange portions 28 which have sharpened slicing edges 30 immediately adjacent to the portion 24. The terminal 20 is mounted within the housing at a central location as shown in FIGS. 2 and 3. A jack screw or stud 32 is received within the channel-shaped portion 26 and is partially encircled thereby. The jack screw 32 is electrically conductive and is provided thereon with external threads 34. The jack screw further includes an enlarged head portion 36 which abuts against a conductive metal shell 38 which partially encircles the base portion 12 and which is electrically grounded to the jack screw 32 by virtue of its contact therewith. As shown in FIGS. 1 and 5 the shell 38 includes a pair of projecting flap portions 40 extending on opposite sides of the base portion 12 and are provided with generally rectangular apertures 42 for a purpose to be described. The cover 14, as shown more particularly in FIGS. 1, 2, 3, and 5 include a pair of integral projecting inclined ramp projections 44 each having a shoulder 46. With reference to FIG. 1 it is to be understood that the wiring device 10 is adapted for connection electrically to the cable 1 by placing the spread apart portions of the individual conductors over the corresponding terminals or contacts 16, 18 and 20 in the base portion 12, and then forcibly advancing the cover 14 toward the base portion 12 forcing the individual conductors 4, 6, and 8 into electrical engagement within the insulation penetrating type contacts 16 and 18 and the contact 20. The inclined projections 44 will enter the corresponding apertures 42 of the jacket or shell 38 and the shoulder portions 46 will lockingly register within the confines of the apertures 42 to lock together cooperatively the cover 14 and the base portion 12 together and thereby contain the electrically connected portions 4, 6, and 8 of the cable 1. Accordingly the wiring device according to the present invention is of the type wherein a two-piece housing is assembled simultaneously when the contained insulation penetrating type terminals are connected electrically to the individual spread apart portions of conductors of an elongated electrical cable. A force applying tool is required for assembly of the two-piece wiring device. The tool must apply sufficient force not only to urge the cover into latching cooperative engagement with the base portion but also to insert forcibly the conductors 4, 6, and 8 together with their individual insulation coverings as well as portions of the outer sheath 2 internally of the insulation penetrating contacts 16, 18 and 20. Provided that the force applied is sufficient the contacts will penetrate through the portions of the sheath 2 and as well as the individual insulation on the wires where present, to grippingly engage the individual conductors 4, 6, and 8 to establish good electrical connections therewith. It is a requirement that such a wiring device be adapted with structure to accommodate assembly of the two-piece device with commonly available tools which are rugged, easy to use and inexpensive. In the case of the present invention the wiring device is adapted with the jack screw 32 which projects toward an open side 48 of the base portion 12. The cover 14 includes a central aperture 50 therethrough which is in alignment with the end of the jack screw 32 providing access thereto. As shown more particularly in FIGS. 1, 2, 3, and 5, one preferred embodiment of the present invention includes a threaded fastener illustrated generally at 52 having a shank portion 54 which is internally threaded and integral with an enlarged head portion 56 containing a central recess 58 which is hexagonal in cross-section. To facilitate assembly of the two-piece wiring device as shown in FIGS. 2 and 3, the individual conductors 16, 18 and 20 are located over the base portion 12 and over the corresponding electrical contacts 16, 18 and 20. The shank 54 of the fastener is freely received for rotation through the aperture 50 of the cover and the fastener 52 is threadably driven along the jack screw 32 by rotation of the fastener by means of a common Allen wrench 60 which is matingly received within the hexagonal aperture 58 for rotation of the fastener 52. As the fastener 52 is threadably driven along the stud 32 the enlarged head 56 will engage the cover forcing it within the opening 48 of the base 12 until the shoulders 46 latchingly or lockingly engage within the corresponding apertures 42 of the jacket or shell 38. The cover includes projecting wall portions 62 which engage and push against corresponding conductors 4 and 6 driving them into electrical connection within the contacts 16 and 18. The contacts are of the type having opposed slicing edges which receive therebetween the conductors 4 and 6 as well as the insulation covering the conductors and portions of the sheath 2 which accompany the conductors when the sheath is slitted and the individual conductors are laterally spread apart from each other. The slicing edges of the contacts penetrate through the sheath 2 and the insulation over the conductors 4 and 6 to electrically grip and partially penetrate the conductors 4 and 6 to establish good electrical connections therewith. In such a manner the wiring device is electrically connected to the conductors 4 and 6. As shown in FIG. 3 the threaded portion 54 of the fastener enters the confines of the terminal 20 and the end of the threaded portion engages and forces the uninsulated conductor 8 into electrical connection within the terminal or contact 20. More particularly, portions of the sheath 2 which are slitted and which accompany the conductor 8 are also forced into the confines of the terminal 20. The slicing edges 30 of the terminal are designed to slice through the sheath 20 when present and partially penetrate the conductor 8 to establish a good electrical connection therewith. The conductor 8 will therefore be gripped between the slicing edges 30 and the portion 24 of the terminal 20. The conductor 8 is an electrically grounded conductor in accordance with established practice in the electrical wiring art. The stud 32 is in contact with the terminal 20 for electrical connection therewith. Thus the stud 32 is electrically grounded to the conductor 8. In addition, the fastener 54 can be made of conductive material such that it too is electrically grounded to the stud 32 which in turn is grounded to the conductor 8. The fastener 52 can therefore remain as an installed part of the cover as shown in FIG. 5 without producing an electrical hazard because it is grounded to the conductor 8. Thus upon assembly of the cover portion 14 and the base portion 12 the wiring device is simultaneously connected electrically to the cable 1. The cover and the base portion cooperate to contain the electrical connection of the conductors 4, 6 and 8 to the corresponding contacts. The protruding portions of the cable 1 which are adjacent to the sliced portions thereof are received to cooperate in notched portions 64 of the base portion and at 66 of the cover portion. The notch portions 64 and 66 cooperate when the cover is locked to the base to grip the periphery of the cable 1 to provide a strain relief. The fastener 52 can also be removed subsequent to locking the cover and base together if desired.

According to a modification of the fastener 52 the enlarged head portion 56 thereof may be provided with a hexogonal shape as illustrated in FIG. 1 at 68. This would allow the use of a standard force applying tool such as a wrench or socket wrench to engage the periphery of the enlarged head 56 and threadably drive the fastener shown at 68 along the stud 32.

According to another modification there is illustrated at 70 a simple and rugged tool which may be utilized to assemble the cover and base portion. The tool 70 includes a threaded portion 72 which corresponds to the threaded portion 54 of the fastener 52. The tool further includes an enlarged head 74 adjacent to the threaded portion 72 which corresponds to the enlarged head 56. An enlarged shaft 76 is integral with the head portion 74 and is provided with a simple transverse bar handle 78. The tool 70 is operated in the same manner as the fastener 58, with the exception being that the tool itself is incorporated into the fastener portion 72 and 74. In such a manner therefore the fastener 52 can be incorporated directly into a force applying tool of the type shown at 70. In this embodiment of the tool 70, the tool as well as the fastener portions 72 and 74 must be removed from the assembled cover and base subsequent to locking together of the cover and base in assembled relationship.

Although preferred embodiments and modifications of the present invention are illustrated and described in detail other modifications and embodiments within the spirit and scope of the appended claims are desired to be covered.

What is claimed is:

1. The method of assembling a wiring device on a multiconductor cable, slitting portions of the cable to separate medial portions of the conductors therein, spreading laterally apart from one another the medial portions of the conductors, aligning the medial portions of the conductors with corresponding electrical terminals contained in a base portion of a wiring device overlying said medial portions with a cover portion of said wiring device, displacing said cover and said base toward each other with a tool whereby said conductors are forced into electrical engagement with said terminals and whereby said cover and said base are locked together, and engaging said tool directly against at least one of said wires and forcing said wire into engagement with a corresponding terminal while displacing said cover and said base toward each other.

2. A method for assembling cable wires into a wiring device, comprising the steps of:

spreading apart portions of said cable wires, overlying electrical terminals within a base portion of a wiring device with said spread apart wires, locating a post adjacent one of said terminals, overlying said wires with a cover portion of said wiring device, exposing said post through said cover portion, advancing a fastener along said post displacing said cover against said wires and driving said wires into electrical connection within corresponding terminals, said fastener being conductive, and electrically grounding said fastener to said ground wire of said cable and driving said ground wire with said fastener into a corresponding terminal upon advancing said fastener along said post.

3. The method as recited in claim 2, wherein, said post comprises a jackscrew, and further including the step of threadably advancing said fastener along said jackscrew to displace said cover against said wires and to drive said ground wire into a corresponding terminal.

4. the method as recited in claim 2, and further including the steps of:

providing latching portions on said base portion of said wiring device, and advancing said fastener along said post to displace said cover into locked retention on said latching portions of said base portion.

5. The method as recited in claim 4, wherein said fastener is integral with a tool provided with a handle, and including the step of:

removing said tool and said fastener subsequent to locked retention of said cover to said base portion.

6. A method for assembling a wiring device, comprising the steps of:

slitting a longitudinal portion of a multi-conductor electrical cable to expose the individual conductors, spreading laterally apart portions of the conductors exposed at the slitted portion of said cable, placing the spread apart portions of the conductors over notched plate type electrical contacts contained within a base portion of a wiring device, locating a jackscrew adjacent a central one of said contacts, locating a cover portion over said base portion with said spread apart portions of said conductors therebetween, driving a conductive and threaded portion of said cover along said jackscrew to force said individual conductors into electrical and gripped connection within corresponding contacts, one of said conductors comprising a ground wire, and driving said conductive portion of said cover against said ground wire forcing said ground wire within a corresponding contact and electrically grounding said conductive portion of said cover to said contact.

7. A method for assembling a wiring device, comprising the steps of:

slitting a longitudinal portion of a multi-conductor electrical cable to expose the individual conductors, spreading laterally apart portions of the conductors exposed at the slitted portion of said cable, placing the spread apart portions of the conductors over notched plate type electrical contacts contained within a base portion of a wiring device, locating a mounting means adjacent a central one of said contacts, locating a cover portion over said base portion with said spread apart portions of said conductors therebetween, advancing said cover portion along said mounting means to force said individual conductors into electrical and gripped connection within corresponding contacts, one of said conductors comprising a ground wire, driving a conductive portion of said cover against said ground wire forcing said ground wire within a corresponding contact and electrically grounding said conductive portion of said cover to said contact, latching said cover to said base to contain therewithin said wiring device and said terminals and the spread apart portions of said conductors connected within said terminals, and removing the conductive portion of said cover subsequent to latching said cover to said base.

* * * * *